United States Patent [19]

Apfelbeck et al.

[11] 4,434,358

[45] Feb. 28, 1984

[54] AIRCRAFT WINDOW HEAT CONTROLLER WITH SWITCHED IMPEDANCES

[75] Inventors: Otto L. Apfelbeck, Fort Shawnee; Joseph M. Urish, Shawnee Township, Lima County, both of Ohio

[73] Assignee: Westinghouse Electric Corp., Pittsburgh, Pa.

[21] Appl. No.: 376,072

[22] Filed: May 7, 1982

Related U.S. Application Data

[63] Continuation of Ser. No. 121,073, Feb. 13, 1980, abandoned.

[51] Int. Cl.[3] ..... H05B 1/02

[52] U.S. Cl. ..... 219/501; 219/508; 219/203; 219/509; 219/494; 328/175; 323/209; 323/235

[58] Field of Search ..... 219/501, 508, 509, 483, 219/486, 494, 498, 201, 203; 323/209, 210, 235, 293; 328/168, 175, 263, 268

[56] References Cited

U.S. PATENT DOCUMENTS

| | | | |
|---|---|---|---|
| 3,300,712 | 1/1967 | Segsworth | 323/209 |
| 4,109,134 | 8/1978 | Van Herten | 219/505 |
| 4,139,723 | 2/1979 | Havas | 373/150 |
| 4,334,147 | 6/1982 | Payne | 219/486 |

FOREIGN PATENT DOCUMENTS

| | | | |
|---|---|---|---|
| 1334571 | 10/1973 | United Kingdom | 323/209 |

OTHER PUBLICATIONS

AFFDL-TR-77-1, vol. 1, "Windshield Technology Demonstration Program," 9-1977, Douglas Aircraft.

*Primary Examiner*—M. H. Paschall
*Attorney, Agent, or Firm*—R. P. Lenart

[57] ABSTRACT

An electrical resistance heater controller is provided with a plurality of circuit branches connected in parallel with each other and in series with a heating element and an external AC power source. Each circuit branch includes the series connection of a capacitor and a solid state switch. The switches are controlled by a gating device to switch during the zero crossing of the AC source voltage waveform. Power delivered to the heating element is controlled by varying the amount of series capacitance in the circuit.

5 Claims, 4 Drawing Figures

AIRCRAFT WINDOW HEAT CONTROLLER WITH SWITCHED IMPEDANCES

This is a continuation of application Ser. No. 121,073, filed Feb. 13, 1980, now abandoned.

BACKGROUND AND SUMMARY OF THE INVENTION

This invention relates to electrical resistance heater controllers and particularly to such controllers for heaters mounted in aircraft windshields that are to be fog and ice free.

In copending application Ser. No. 116,515, filed Jan. 29, 1980 by the present inventors and assigned to the present assignee, there is discussion of previous practices and proposals for controlling the application of power to aircraft windshield heaters. In the copending application there was presented an improved form of window heat controller employing a high frequency switch to control the average power delivered to the load. High frequency switching is favorable in that it permits some reduction of the size of filter components to buffer the input line from the switching load current. However, additional filtering on the output side of the high frequency switch is also required. Hence, it has been considered desirable to develop further forms of window heat controllers with the purpose of achieving efficient use of electrical energy, low cost and weight, good operational reliability, and easy maintenance.

In certain power control applications, such as described in Havas U.S. Pat. No. 4,139,723, Feb. 13, 1979, it is generally known that a parallel set of capacitors can be controlled by having a switch associated with each capacitor between the source and the load in order to variably control the amount of power applied in discrete steps depending on the amount of impedance in the circuit at a given time.

The present invention uses a switched impedance power controller as a resistance heater controller wherein a plurality of parallel circuit branches are connected between the source and the heating element and each comprises a capacitor and a solid state switching device in series with each other. The solid state switching devices are turned on and off by gating means utilizing a window temperature signal so that a variably controlled amount of capacitance is in circuit between the source and the heating element to maintain the window temperature within a predetermined range. Rather than switching at peak power levels, as in the aforementioned patent, the gating means comprises means for switching the switching devices on and off substantially at the zero crossing of the AC source voltage waveform which utilizes the properties of AC switches in a better manner.

It is preferred that the capacitors in the respective branches be of unequal capacitance value to provide a greater range of total capacitance from which the controller can select. That is, for example, if there are at least four parallel branches whose respective capacitors have capacitance values in a ratio of 1:2:4:8, there are sixteen relative capacitance values provided from zero to fifteen units. Of course a greater or smaller number of capacitors can be used with different capacitance weightings.

For the sake of simplicity, economy and low weight, the solid state switching devices are preferably each a unitary bilateral AC switch associated with a respective capacitor without additional components in the parallel circuit branch. The switch may, for example, by of the type commercially available and sold as a "Triac" switching device.

The gating system for the solid state switches may be relatively simple in form including some form of interface circuit or comparator to compare the sensed window temperature signal with a reference and to apply gating signals to the switching devices so the controller goes to the power level required to maintain the desired temperature. In more elaborate and expensive systems, as may be required in aircraft, a microcomputer may be used to process signals from the temperature sensor as well as from other inputs which it may be desired to have control the controller such as signals proportional to the heater circuit voltage and current plus others for reliability assurance and for built-in testing.

Switched impedance window heat controllers in accordance with this invention achieve a good output waveform with very low harmonic content, result in very little input power line disturbance, because power is decreased in relatively small steps and the input current is sinusoidal with zero crossover turn-on, and the heater element is inherently protected against DC voltages. Additionally, it is favorable that the capacitors and solid state switches employed in the controller have a high percentage of possible failure modes that result in graceful degradation rather than catastrophic failure.

Capacitors are low power dissipation components and thus enhance controller efficiency. The estimated capacitor weight to provide an equal amount of power is approximately sixty percent of the weight of filter components needed in a phase angle controller in accordance with the prior art. Thus, high efficiency as well as low weight is achieved.

DESCRIPTION OF THE PREFERRED EMBODIMENTS

Figure 1:
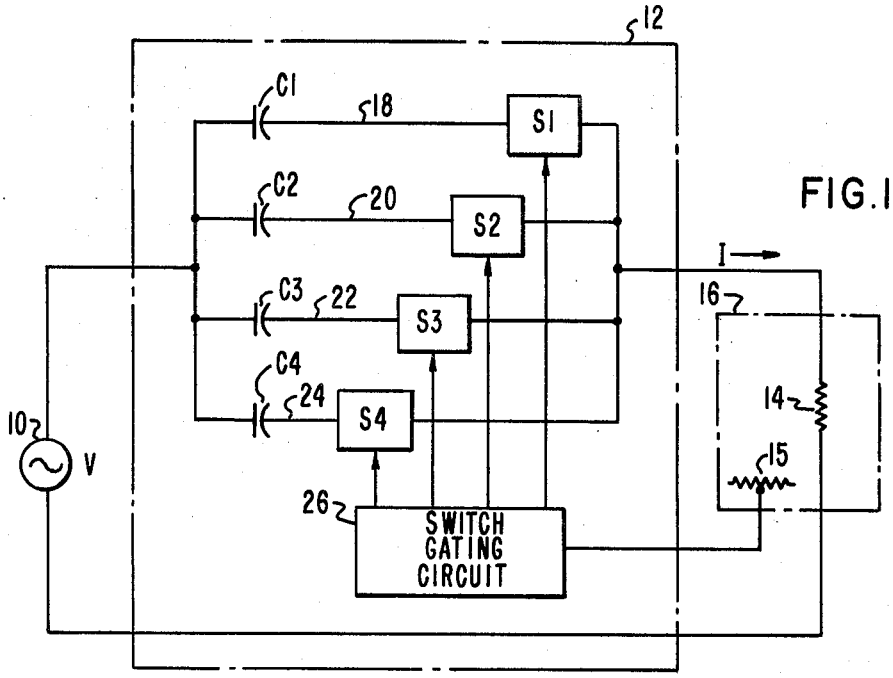
FIG. 1 is a general circuit schematic of a switched impedance power controller for aircraft windows in accordance with the present invention.

Referring to FIG. 1, a window heat control system is shown in which power from a source such as generator 10 is supplied through a switched impedance controller 12 to a heating element 14 in a window 16. The generator 10, which may be of any number of phases, supplies single phase AC power to a plurality of parallel circuit branches 18, 20, 22 and 24 in the controller, each of which comprises respective capacitors C1, C2, C3 and C4 in series relation with respective solid state switching devices S1, S2, S3 and S4. A switch gating circuit 26 receives a temperature proportional signal from the temperature sensing element 15 in the window 16 which variably controls the switching of the solid state switches so that an amount of series capacitance is effectively in the power circuit to enable the controller to maintain the window temperature within a predetermined range.

The four parallel circuit branches, shown as being connected between the source and heating element 14, are merely illustrative as the number may be varied. Also, the amounts of capacitance of each capacitor may be of equal or different magnitude but are preferably of different magnitude to provide a greater range of control. For example, in one form of the invention, the capacitors C1 to C4 are chosen with relative values of 1, 2, 4, and 8. Thus, if C1 is 7 microfarads, then C2 to C4 have values of 14, 28 and 56 microfarads, respectively. With this weighting, AC switches S1 through S4 permit selection of any of the sixteen different relative capacitance values of zero through fifteen unit values or zero to 105 microfarads, depending upon which and how many of the solid state switches are turned on. It can be seen that a greater or smaller number of capacitors can be used resulting in greater or smaller numbers of relative capacitance values.

The window heating current I, is primarily a function of the supply voltage V, the circuit capacitance C, and the resistance of the window R, in the following relationship:

$$I=V/(R^2+X_c^2)^{\frac{1}{2}},$$

where $X_c=\frac{1}{2}\pi fC$ and f is the applied voltage frequency.

Thus, varying the series capacitance, of the circuit branches connected between the source and heating element 14 by selectively energizing various combinations of switches S1 through S4, will provide control of window heating current.

Figure 2:
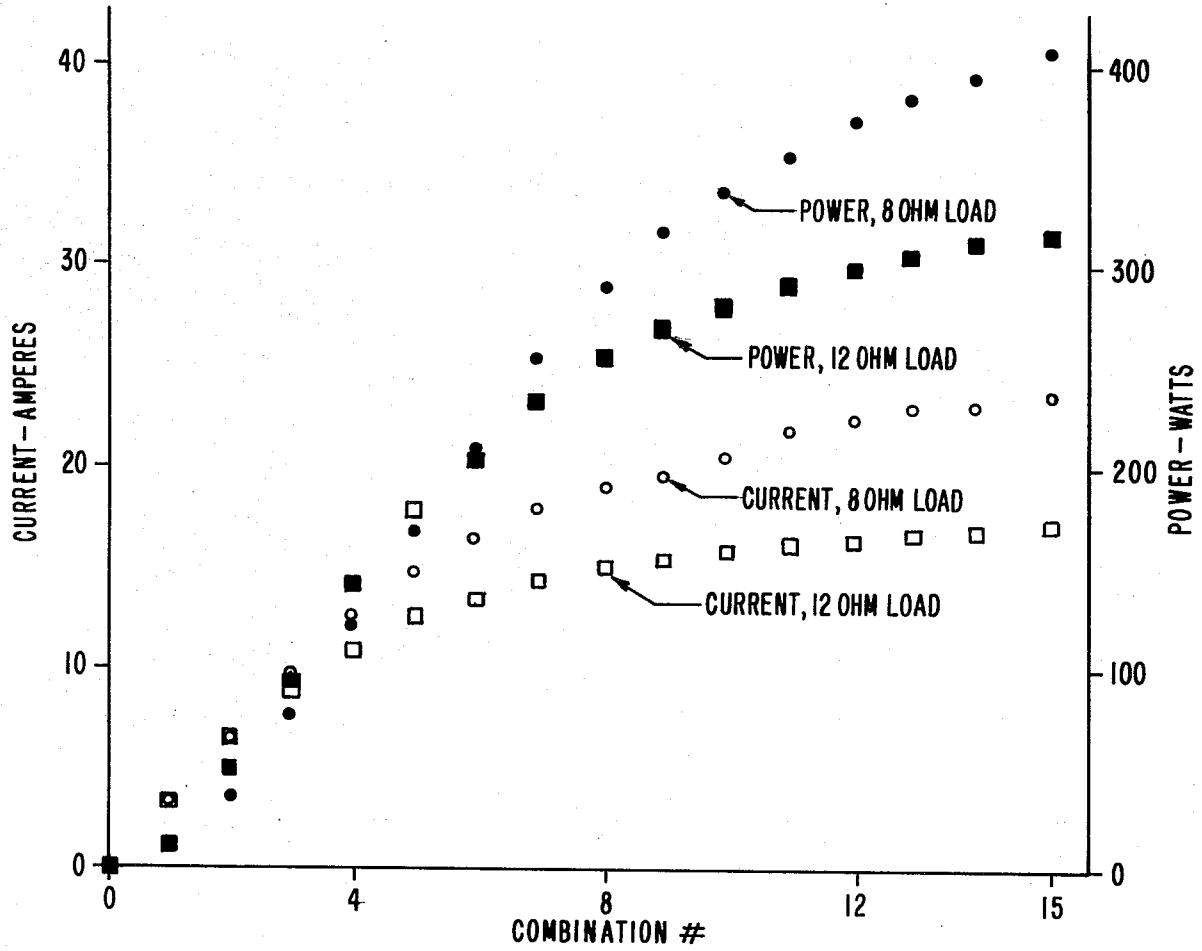
FIG. 2 is a plot of output current and power against controller impedance illustrating performance of controllers in accordance with the present invention.

FIG. 2 is a plot of current and power for loads of 8 and 12 ohms in relation to combinations of capacitors with four capacitor branches of respectively 7 microfarads and multiples thereof as described above. It is to be noted that while the values of delivered power and current are discrete, and thus the output is not infinitely variable, a high degree of control is achieved by the use of different numbers of capacitors. Sixteen combination values (numbered as combinations 0 through 15) are possible with the example of four capacitors as mentioned. If three capacitors are used, with a ratio of 1:2:4, eight values are possible. If five capacitors are used with a ratio of 1:2:4:8:16, thirty-two values are obtained, and so on. In operation, load current will increase in steps until the desired operating temperature is reached. The controller will vary the output current between two or more adjacent discrete values so as to supply the average power required to maintain the window temperature relatively constant.

Figure 3:
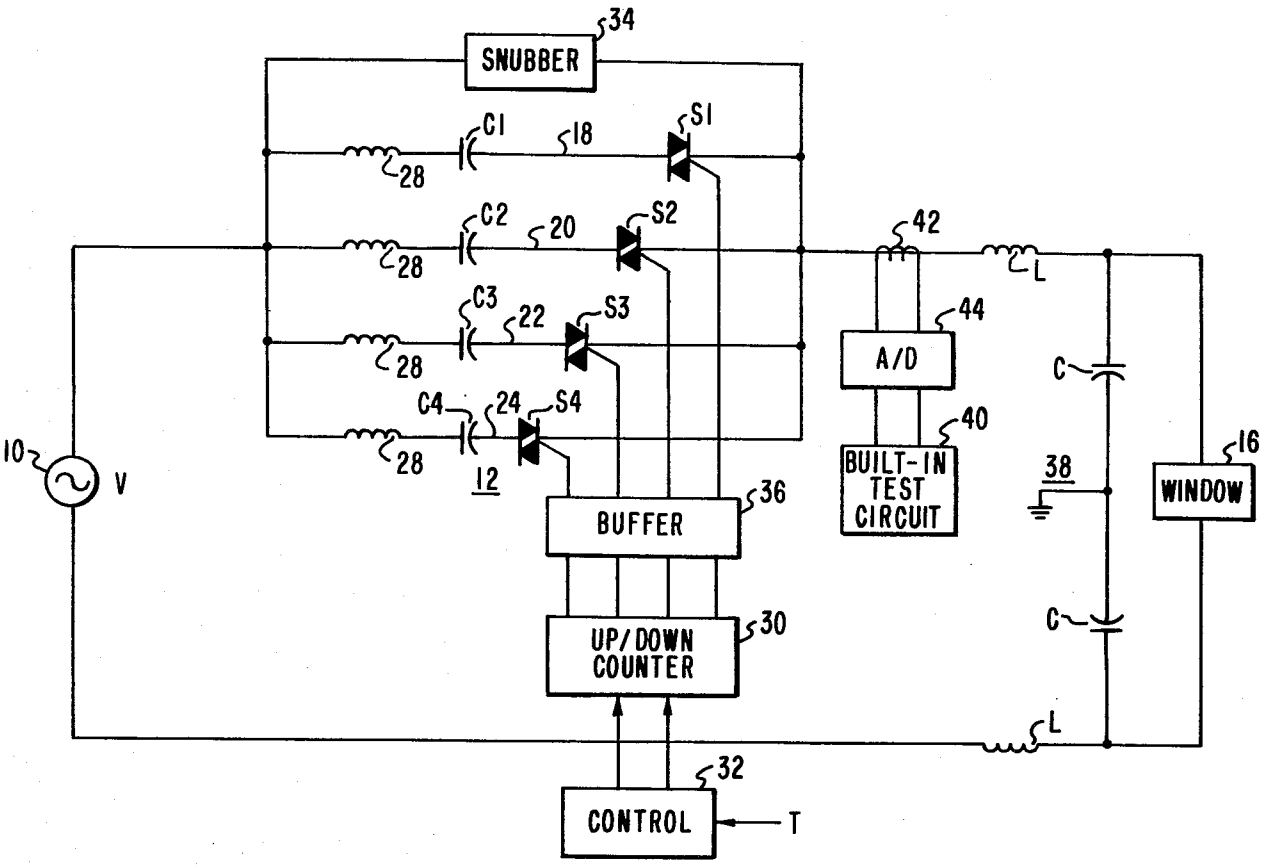
FIG. 3 is a further circuit schematic of an embodiment of the present invention.

FIG. 3 shows a further schematic in which the solid state switching devices S1 through S4 are full wave silicon AC switches of the "Triac" type, although silicon controlled rectifiers (SCR's or thyristors) or transistors may be connected to perform an equivalent function although generally more components would be required. For example, each solid state switching means S1 through S4 may comprise two SCR's connected in inverse parallel relation for full value conduction.

Also shown in each of the parallel circuit branches is a device to provide di/dt limiting, such as an inductor, which is an optional device in the circuit and is preferably avoided by selection of appropriate AC switches and the utilization of zero crossover switching.

A preferred method of controlling the switch is to use a binary up/down counter 30 with the lowest order bit controlling S1, which is associated with C1, the smallest capacitor. This provides a monotonic variation of capacitances with count increases or decreases when the capacitor weighting suggested above is used. A control circuit 32, using the heater temperature feedback signal T, determines whether the counter should count down (providing less load current), count up (providing more load current), or remain at the present count.

For example, if the counter state is binary 0101 (decimal 5) then switches S1 and S3 are on and the equivalent capacitance is 7+28 or 35 microfarads. If the count increases by one, the counter state is binary 0110 (decimal 6) and switches S2 and S3 are now on and the equivalent capacitance is 14+28 or 42 microfarads. In this manner, any of the available capacitance values is readily obtained.

Also shown in the circuit of FIG. 3 is a snubber 34 connected across all of the parallel branches which may be of the Zener diode type but is preferably also not necessary with appropriate selection of the AC switches, the characteristics of the AC supply and the overall performance requirements.

The counter 30, which may be of conventional configuration is associated with the gate terminals of the switches S1 through S4 through a buffer element 36 in accordance with known digital circuit design.

An output filter 38 is provided of inductances L and capacitances C to attenuate harmonics generated by the non-perfect character of the AC switches about their zero current crossover point. The value of inductance employed also influences the snubber component values as will be recognized.

The control circuit 32 may include a simple analog to digital converter whose output is proportional to the temperature error signal and this digital output is used to control the switches. Thus, the temperature proportional signal from the heater is compared with a reference to determine the error signal that is converted into digital format.

The use of capacitors in the switched impedance controller is preferred as other impedance elements would not provide the advantages of assuring that no DC voltage is applied to the window. A DC component, whatever its source, will show up as a charge on the capacitor bank. A DC voltage on the window heating element is undesirable.

The controller provides a high degree of reliability and performance because if one of the capacitors opens, maximum power output is reduced but otherwise operation remains normal. If one of the capacitors shorts, full supply voltage is applied to the window when the associated switch is closed. Fuses may be included in series with all but the highest value capacitor bank to clear shorted capacitors. A fault occurring because of shorting of the highest valued capacitor would produce maximum current as illustrated in FIG. 2 in which full power is supplied, however, the line current could only increase by twenty to forty percent depending on line voltage and window resistance. Thus, open or shorted capacitors result in degraded but acceptable operation.

Typical AC switches that can be used to control each capacitor bank may fail in an opened, shorted, or half wave manner. All of these failure modes may not be possible depending on the specific implementation selected. If any switch fails in an open or off condition, the associated capacitor bank is lost and maximum power output is reduced but otherwise operation is normal. If any switch fails shorted or on, the associated capacitor bank continuously supplies its share of load current (from 15 to 90% full load depending upon the switch that fails, and the window resistance). This condition could result in window overheating but will be detected by an overheating monitoring circuit. Otherwise, operation remains normal.

If any switch fails such that it is conductive for only one direction of current flow, on half waves, the resulting DC voltage will appear across the associated capacitor bank. Thus no special precaution is needed to be taken to protect the window from a DC component in the event of a halfwave failure.

Because many of the failure modes discussed above can result in apparently normal operation, a built-in test circuit 40 is desirable to detect them.

Figure 4:
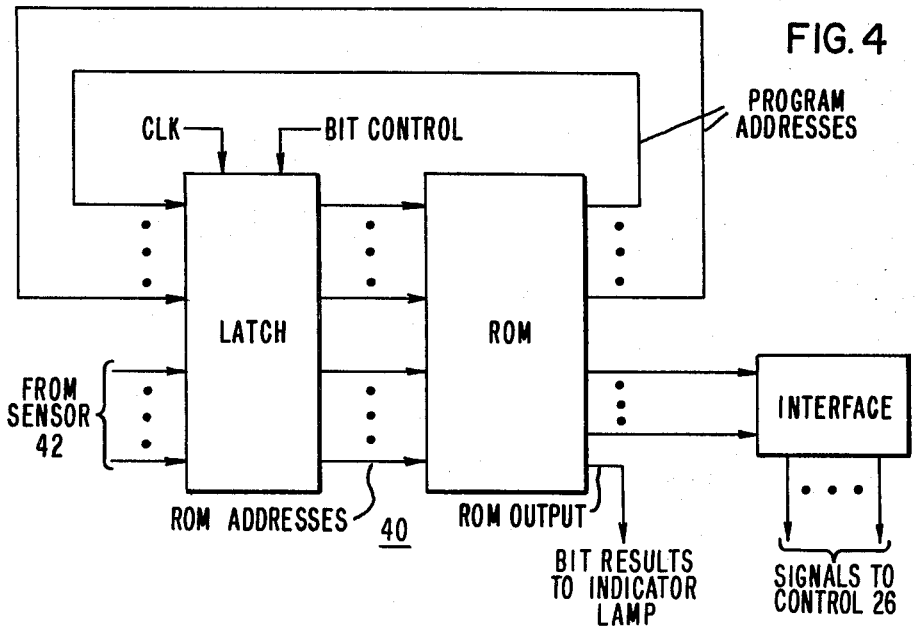
FIG. 4 is a circuit schematic of a built-in-test circuit for the power controller.

FIG. 3 shows schematically a current transformer 42 for sensing load current and supplying a proportional signal to built-in test circuit 40 through an analog to digital converter 44. The basic approach would be to utilize a microprocessor in an arrangement such as that shown in FIG. 4. A microprogram would be developed and placed in a read only memory ROM. Part of the ROM output is fed back to the input through a Latch to control program execution. Normally the built-in test operation would be initiated by an external switch. The first ROM address would be selected and its output would generate the appropriate built-in test signals to the interface/buffer peripheral circuits. The appropriate test result signals, such as output current, to the window heating element monitored by a current transformer in the analog to digital conversion, are connected to the ROM latch. After an appropriate delay, to allow test signals to stabilize, the latch is clocked to apply the next instruction address. Thus, the results of the test determine the next instruction that will be executed. If test results are okay, the next test is run; if not, testing is stopped and so indicated. Other options can be included by changes in the microprogram.

It is presently considered desirable that the built-in tests include turning on each switch and measuring the output current. This will detect all openings and shorts in the capacitors as well as all opens, shorts and half wave operation in the AC switches. Also, the built-in test should preferably force window temperature bridge output low, then high, and determine that the overheat sensing circuits respond properly.

In operation of breadboard models with an input voltage of 200 volts, 400 hertz, and a load provided by resistive load banks set at 8 to 11.2 ohms and the capacitors as described, the output current was found on an ocilloscope to be sinusoidal and clean with no transients during switching between combinations. The output current for each combination was measured and compared to calculated values with good correlation.

It is therefore believed that the switched impedance power controller presents attractive features for window heater control. It provides a good output waveform and a sinusoidal current whose magnitude is variable in discrete steps. There is low input power disturbance. The largest change in power input is less than 500 watts. Failures of power controlling elements, the capacitors or switches, results in controlled degradation. The capacitors are inherently low power dissipation components and thus enhance efficiency. The controller may be a low weight unit. The estimated weight of capacitors needed to provide 4000 watts to an 8 ohm window weigh 4.5 pounds, which is only 60% of the filter weight required in phase angle control in accordance with the prior art.

Thus, improvements in window heater controllers are described which may of course be varied in accordance with this description from the particular examples supplied.

What we claim is:

1. An electrical resistance heater controller, for controlling application of power from an AC source to a heating element, comprising:

a plurality of parallel circuit branches, each connected in series with an AC source and a heating element and each comprising a capacitor and gate-controlled solid state switching means in series with each other;

gating means for switching individual ones of said solid state switching means on and off in accordance with a heating element temperature signal so that a variable controlled amount of capacitance is in series between the source and the heating element to maintain the heating element temperature within a predetermined range, said gating means comprising means for switching said solid state switching means on and off substantially at the zero crossing of the AC source voltage waveform.

2. An electrical resistance heater controller in accordance with claim 1 wherein:

said plurality of parallel circuit branches comprise capacitors in respective branches of unequal capacitance value to provide a range of total capacitance between the source and the heating element that varies depending on which and how many of said solid state switching devices are turned on.

3. An electrical resistance heater controller in accordance with claim 2 wherein:

said parallel circuit branches number at least four and said capacitors have capacitance values in a ratio of 1:2:4:8.

4. An electrical resistance heater controller in accordance with either of claims 1, 2 or 3 wherein:

said solid state switching means are each a bilateral AC switch associated with a respective capacitor.

5. An electrical resistance heater controller in accordance with either of claims 1, 2, or 3 further comprising:

means for monitoring output current from said parallel circuit branches and for testing the operability of said capacitors and solid state switching devices.

* * * * *